US010906796B2

(12) United States Patent
Naik et al.

(10) Patent No.: US 10,906,796 B2
(45) Date of Patent: Feb. 2, 2021

(54) REFRIGERATOR DISPENSER CONTROL WITH MULTI FUNCTION CONTROL PADDLE

(71) Applicant: Midea Group Co., Ltd., Foshan (CN)

(72) Inventors: Vinayak Naik, Louisville, KY (US); Eric Scalf, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 16/425,297

(22) Filed: May 29, 2019

(65) Prior Publication Data

US 2020/0377357 A1 Dec. 3, 2020

(51) Int. Cl.

| | |
|---|---|
| ***B67D 3/00*** | (2006.01) |
| ***F25C 5/20*** | (2018.01) |
| ***F25D 23/02*** | (2006.01) |
| ***F25D 23/12*** | (2006.01) |

(52) U.S. Cl.

CPC ..... *B67D 3/0025* (2013.01); *F25C 5/22* (2018.01); *F25D 23/028* (2013.01); *F25D 23/126* (2013.01); *B67D 2210/00036* (2013.01); *F25C 2400/10* (2013.01)

(58) Field of Classification Search

CPC ..... B67D 2210/00036; B67D 3/0025; F25C 5/22; F25C 2400/10; F25C 2600/04; F25D 23/028; F25D 23/126; B65B 57/02

USPC ..... 222/80

See application file for complete search history.

(56) References Cited

U.S. PATENT DOCUMENTS

| | | | | |
|---|---|---|---|---|
| 7,060,915 | B2 * | 6/2006 | Bricaud | H01H 25/002 200/1 R |
| 8,348,108 | B2 | 1/2013 | Choi | |
| 8,573,001 | B2 | 11/2013 | Koo | |
| 8,820,583 | B2 | 9/2014 | Kim | |
| 8,984,899 | B2 | 3/2015 | Mitchell | |
| 9,073,743 | B2 | 7/2015 | Sanchez et al. | |
| 9,208,969 | B2 | 12/2015 | Berger | |
| 9,285,159 | B2 | 3/2016 | Kim | |
| 9,738,504 | B2 | 8/2017 | Aranda et al. | |
| 9,739,518 | B2 | 8/2017 | Moon | |
| 9,901,886 | B2 | 2/2018 | Kim et al. | |
| 10,101,080 | B2 | 10/2018 | Willis et al. | |

(Continued)

FOREIGN PATENT DOCUMENTS

| | | |
|---|---|---|
| CN | 203100331 U | 7/2013 |
| CN | 206695462 U | 12/2017 |

(Continued)

OTHER PUBLICATIONS

Written Opinion and International Search Report issued in Application No. PCT/CN2020/092486, dated Aug. 28, 2020.

*Primary Examiner* — Timothy P. Kelly
*Assistant Examiner* — Christopher M Afful
(74) *Attorney, Agent, or Firm* — Middleton Reutlinger

(57) ABSTRACT

A refrigerator utilizes a dispenser control with a multi-function control paddle to perform multiple dispenser functions in response to different types of actuation of the control paddle. The control paddle may be positioned below one or more dispenser openings and pivotable in multiple directions about one or more axes such that placement of a container below the one or more dispenser openings and against different actuation regions of the control paddle will initiate different dispenser functions.

24 Claims, 6 Drawing Sheets

(56) References Cited

U.S. PATENT DOCUMENTS

| | | | | |
|---|---|---|---|---|
| 2005/0268639 | A1* | 12/2005 | Hortin | B67D 1/0009 62/389 |
| 2006/0131324 | A1 | 6/2006 | Noh et al. | |
| 2011/0132021 | A1* | 6/2011 | Fulton | F25C 5/22 62/389 |
| 2011/0226815 | A1 | 9/2011 | Chou | |
| 2013/0091772 | A1 | 4/2013 | Berger et al. | |
| 2014/0042186 | A1* | 2/2014 | Clancy | B67D 7/36 222/144.5 |
| 2015/0300729 | A1 | 10/2015 | Seo et al. | |
| 2016/0083238 | A1 | 3/2016 | Koo | |
| 2017/0174493 | A1 | 6/2017 | Aranda et al. | |
| 2018/0209718 | A1 | 7/2018 | Staud et al. | |

FOREIGN PATENT DOCUMENTS

| | | | |
|---|---|---|---|
| CN | 208688090 | U | 4/2019 |
| DE | 102017219044 | A1 | 4/2019 |

* cited by examiner

REFRIGERATOR DISPENSER CONTROL WITH MULTI FUNCTION CONTROL PADDLE

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. Various refrigerator designs have been used, including, for example, top mount refrigerators, which include a freezer compartment near the top of the refrigerator, either accessible via a separate external door from the external door for the fresh food compartment, or accessible via an internal door within the fresh food compartment; side-by-side refrigerators, which orient the freezer and fresh food compartments next to one another and extending generally along most of the height of the refrigerator; and bottom mount refrigerators, which orient the freezer compartment below the fresh food compartment and including sliding and/or hinged doors to provide access to the freezer and fresh food compartments.

Irrespective of the refrigerator design employed, many refrigerator designs also include an externally-accessible dispenser that is disposed at a convenient height on the front of the refrigerator, most often on the surface of one of the doors that provide access to one of the refrigerator compartments. Many dispensers are configured to dispense cooled water along with either cubed or crushed ice, although other dispensers may support other functions, such as dispensing hot water, sparkling water, coffee, etc.

With many dispenser designs, one or more container-actuated paddles are used to control dispensing. A common container-actuated paddle design extends downwardly from a mounting point disposed at a top end of the paddle and proximate the dispenser opening, and rotates about a horizontal axis such that a consumer can place cup, glass or other container underneath the dispenser opening and use the cup or glass itself to push the paddle rearwardly to activate the dispenser. In some instances, water and ice are dispensed from separate dispenser openings that are oriented side-by-side using separate paddles that are positioned below the respective openings so that a consumer can select between water and ice dispensing simply by placing the container under the appropriate opening and engaging the associated paddle. In other instances, however, the water and ice dispenser openings are oriented proximate to one another such that a single paddle may be used to dispense water or ice depending upon a particular mode selected by a user.

Mode selection may generally be performed using a number of different techniques, e.g., using a knob, a slider, a set of buttons, a touchscreen, etc., that may be selected in advance of actuating a paddle. Even when separate paddles are used, mode selection may still be required, e.g., to select between dispensing cubed or crushed ice.

Requiring additional mode selection in connection with dispensing from a refrigerator dispenser, however, complicates dispensing, as many consumers would generally prefer to interact with a dispenser simply by placing a container underneath the appropriate dispenser opening.

SUMMARY

The herein-described embodiments address these and other problems associated with the art by providing a refrigerator that utilizes a dispenser control with a multi-function control paddle to perform multiple dispenser functions in response to different types of actuation of the control paddle. The control paddle may be positioned below one or more dispenser openings and pivotable in multiple directions about one or more axes such that placement of a container below the one or more dispenser openings and against different actuation regions of the control paddle will initiate different dispenser functions.

Therefore, consistent with one aspect of the invention, a refrigerator may include a cabinet including one or more food compartments and one or more doors closing the one or more food compartments, and a dispenser mounted to the cabinet to dispense a plurality of dispense products. The dispenser may include one or more dispenser openings configured to dispense the plurality of dispense products, and a dispenser control positioned below the one or more dispenser openings and actuatable by a container placed below the one or more dispenser openings, the dispenser control including a control paddle being pivotable in first and second directions about a generally vertical axis, where pivoting of the control paddle about the generally vertical axis in the first direction actuates the dispenser to dispense a first dispense product among the plurality of dispense products, and pivoting of the control paddle about the generally vertical axis in the second direction actuates the dispenser to dispense a second dispense product among the plurality of dispense products.

In some embodiments, the control paddle is further pivotable about a generally horizontal axis, and pivoting of the control paddle about the generally horizontal axis actuates the dispenser to dispense a third dispense product among the plurality of dispense products. Also, in some embodiments, the control paddle is pivotable in third and fourth directions about the generally horizontal axis, pivoting of the control paddle about the generally horizontal axis in the third direction actuates the dispenser to dispense the third dispense product, and pivoting of the control paddle about the generally horizontal axis in the fourth direction actuates a predetermined dispenser function. Further, in some embodiments, the predetermined dispenser function is a dispenser lock or dispenser unlock function.

In some embodiments, pivoting of the control paddle about the generally horizontal axis in combination with pivoting of the control paddle about the generally vertical axis in the first direction actuates the dispenser to concurrently dispense both the first and third dispense products. In addition, in some embodiments, pivoting of the control paddle about the generally horizontal axis in combination with pivoting of the control paddle about the generally vertical axis in the second direction actuates the dispenser to concurrently dispense both the second and third dispense products.

In some embodiments, the dispenser further includes an additional user control having a plurality of states, and pivoting of the control paddle about the generally vertical axis in the first direction actuates the dispenser to dispense the first dispense product further based upon a selected state of the additional user control. In addition, in some embodiments, the plurality of states of the additional user control includes an ice dispensing state and a water dispensing state, and pivoting of the control paddle about the generally vertical axis in the first direction when the additional user control is in the ice dispensing state actuates the dispenser to dispense cubed ice, pivoting of the control paddle about the generally vertical axis in the second direction when the additional user control is in the ice dispensing state actuates the dispenser to dispense crushed ice, and pivoting of the control paddle about the generally vertical axis in the first direction when the additional user control is in the water dispensing state actuates the dispenser to dispense water.

Moreover, in some embodiments, pivoting of the control paddle about the generally vertical axis in the second direction when the additional user control is in the water dispensing state actuates the dispenser to dispense water. In some embodiments, pivoting of the control paddle about the generally vertical axis in one of the first and second directions when the additional user control is in the water dispensing state actuates the dispenser to dispense cooled water, and pivoting of the control paddle about the generally vertical axis in the other of the first and second directions when the additional user control is in the water dispensing state actuates the dispenser to dispense a secondary beverage. Moreover, in some embodiments, the secondary beverage is hot water or sparkling water.

In some embodiments, the dispenser control includes a generally vertical hinge and first and second switches disposed on opposite sides of the generally vertical hinge, the first switch engaged in response to pivoting of the control paddle about the generally vertical axis in the first direction, and the second switch engaged in response to pivoting of the control paddle about the generally vertical axis in the second direction.

In addition, in some embodiments, the dispenser control includes a multi-axis sensor configured to sense pivoting of the control paddle about multiple axes. In some embodiments, the dispenser control is a variable dispenser control, and the dispenser is configured to vary a dispense rate in response to the dispenser control. Moreover, in some embodiments, each of the first and second dispense products is cooled water, cubed ice, crushed ice, hot water, sparkling water, a beverage or coffee.

Consistent with another aspect of the invention, a refrigerator may include a cabinet including one or more food compartments and one or more doors closing the one or more food compartments, and a dispenser mounted to the cabinet to dispense a plurality of dispense products. The dispenser may include one or more dispenser openings configured to dispense the plurality of dispense products, and a dispenser control positioned below the one or more dispenser openings and actuatable by a container placed below the one or more dispenser openings, the dispenser control including a control paddle being pivotable in a plurality of directions and about multiple axes to actuate the dispenser to perform three or more dispenser functions.

Also, in some embodiments, each of the three or more dispenser functions is a cooled water dispense function, a cubed ice dispense function, a crushed ice dispense function, a hot water dispense function, a sparkling water dispense function, a beverage dispense function, a coffee dispense function, a dispenser lock function, a dispenser unlock function, or a multiple dispense product dispense function.

Consistent with another aspect of the invention, a refrigerator dispenser may include one or more dispenser openings configured to dispense a plurality of dispense products, and a dispenser control positioned below the one or more dispenser openings and actuatable by a container placed below the one or more dispenser openings, the dispenser control including a control paddle being pivotable in a plurality of directions and about one or more axes to actuate the dispenser to perform two or more dispenser functions.

In some embodiments, each of the two or more dispenser functions is a cooled water dispense function, a cubed ice dispense function, a crushed ice dispense function, a hot water dispense function, a sparkling water dispense function, a beverage dispense function, a coffee dispense function, a dispenser lock function, a dispenser unlock function, or a multiple dispense product dispense function.

In addition, in some embodiments, the one or more axes includes a generally vertical axis and the plurality of directions includes first and second directions about the generally vertical axis, pivoting of the control paddle about the generally vertical axis in the first direction actuates the dispenser to dispense a first dispense product among the plurality of dispense products, and pivoting of the control paddle about the generally vertical axis in the second direction actuates the dispenser to dispense a second dispense product among the plurality of dispense products. Also, in some embodiments, the one or more axes further includes a generally horizontal axis, and pivoting of the control paddle about the generally horizontal axis actuates the dispenser to dispense a third dispense product among the plurality of dispense products.

Consistent with another aspect of the invention, a method of operating a refrigerator dispenser of a type including one or more dispenser openings configured to dispense a plurality of dispense products may include performing a first dispenser function among a plurality of dispenser functions in response to sensing actuation of a control paddle of the dispenser control positioned below the one or more dispenser openings in a first direction about one or more axes about which the control paddle is pivotable, and performing a second dispenser function among the plurality of dispenser functions in response to sensing actuation of the control paddle in a second direction about the one or more axes.

Moreover, in some embodiments, each of the plurality of dispenser functions is a cooled water dispense function, a cubed ice dispense function, a crushed ice dispense function, a hot water dispense function, a sparkling water dispense function, a beverage dispense function, a coffee dispense function, a dispenser lock function, a dispenser unlock function, or a multiple dispense product dispense function.

Further, in some embodiments, the one or more axes includes a generally vertical axis and the first and second directions are about the generally vertical axis, the first dispenser function actuates the dispenser to dispense a first dispense product among the plurality of dispense products, and the second dispenser function actuates the dispenser to dispense a second dispense product among the plurality of dispense products. Also, in some embodiments, the one or more axes further includes a generally horizontal axis, and the method further includes performing a third dispenser function among the plurality of dispenser functions in response to sensing actuation of the control paddle in a third direction about the generally horizontal axis.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
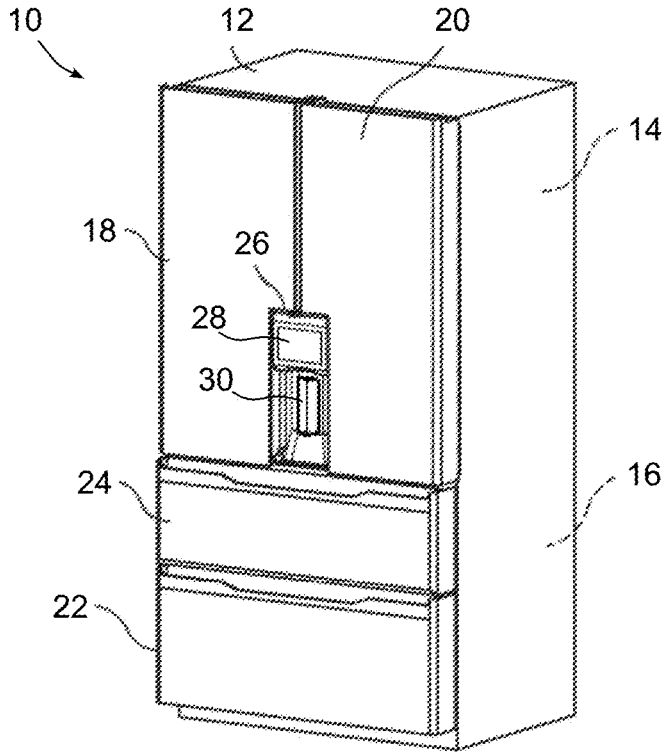
FIG. 1 is a perspective view of an example implementation of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet or case 12 including one or more food storage compartments (e.g., a fresh food compartment 14 and a freezer compartment 16), as well as one or more fresh food compartment doors 18, 20 and one or more freezer compartment doors 22, 24 disposed adjacent respective openings of food storage compartments 14, 16 and configured to insulate the respective food storage compartments 14, 16 from an exterior environment when the doors are closed.

Fresh food compartment 14 is generally maintained at a temperature above freezing for storing fresh food such as produce, drinks, eggs, condiments, lunchmeat, cheese, etc. Various shelves, drawers, and/or sub-compartments may be provided within fresh food compartment 14 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 16 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, fresh food compartment doors 18, 20 are side-by-side fresh food compartment doors that are hinged along the left and right sides of the refrigerator to provide a wide opening for accessing the fresh food compartment. Freezer compartment doors 22, 24 are sliding freezer compartment doors that are similar to drawers and that pull out to provide access to items in the freezer compartment. Both the fresh food compartment and the freezer compartment may be considered to be full width as they extend substantially across the full width of the cabinet 12. It will be appreciated, however, that other door designs may be used in other embodiments, including various combinations and numbers of hinged and/or sliding doors for each of the fresh food and freezer compartments (e.g., a pair of French freezer doors, a single sliding freezer door, or one hinged fresh food and/or freezer door). Moreover, while refrigerator 10 is a bottom mount refrigerator with freezer compartment 16 disposed below fresh food compartment 14, the invention is not so limited, and as such, the principles and techniques may be used in connection with other types of refrigerators in other embodiments, e.g., top mount refrigerators, side-by-side refrigerators, etc.

Refrigerator 10 also includes a cabinet-mounted dispenser 26 for dispensing ice and/or water. Dispenser 26 may include one or more external user controls and/or displays, including, for example, a touch screen 28 and a multi-function dispenser control 30 consistent with some embodiments of the invention. In the illustrated embodiments, dispenser 26 is an ice and water dispenser capable of dispensing both ice and chilled water, while in other embodiments, dispenser 26 may be an ice only dispenser for dispensing only cubed and/or crushed ice. In still other embodiments, dispenser 26 may additionally dispense hot water, sparkling water, coffee, beverages, or other liquids, and may have variable and/or fast dispense capabilities. In some instances, ice and water may be dispensed from the same location, while in other instances separate locations may be provided in the dispenser for dispensing ice and water. In addition, while dispenser 26 is illustrated as being mounted on the cabinet 12, and thus separate from any door, in other embodiments dispenser 26 may be door-mounted, and as such, may be disposed on a fresh food or freezer door. In still other embodiments, dispenser 26 may be disposed within a compartment of a refrigerator, and accessible only after opening a door.

Figure 2:
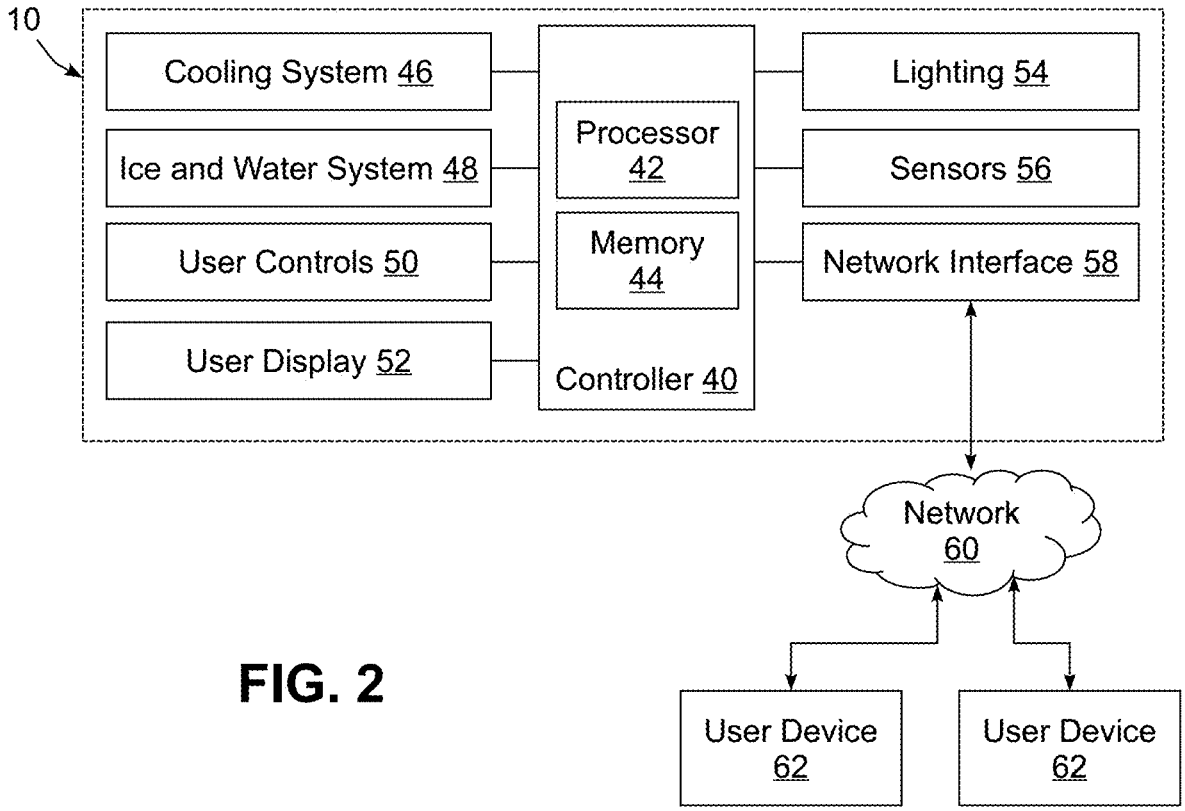
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example embodiment of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40.

As shown in FIG. 2, controller 40 may be interfaced with various components, including a cooling or refrigeration system 46, an ice and water system 48, one or more user controls 50 for receiving user input (e.g., various combinations of switches, knobs, buttons, sliders, touchscreens or touch-sensitive displays, microphones or audio input devices, image capture devices, etc.), and one or more user displays 52 (including various indicators, graphical displays, textual displays, speakers, etc.), as well as various additional components suitable for use in a refrigerator, e.g., interior and/or exterior lighting 54, among others. User controls and/or user displays 50, 52 may be disposed, for example, on one or more control panels disposed in the interior and/or on doors and/or other external surfaces of the refrigerator, and may include, for example, touchscreen 28 and dispenser control 30 illustrated in FIG. 1 and discussed in greater detail below. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Controller 40 may also be interfaced with various sensors 56 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments. Sensors 56 may also include additional types of sensors such as door switches, switches that sense when a portion of an ice dispenser has been removed, and other status sensors, as will become more apparent below.

In some embodiments, controller 40 may also be coupled to one or more network interfaces 58, e.g., for interfacing with external devices via wired and/or wireless networks such as Ethernet, Wi-Fi, Bluetooth, NFC, cellular and other suitable networks, collectively represented in FIG. 2 at 60. Network 60 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 62 over network 60, e.g., computers, tablets, smart phones, wearable devices, etc., and through which refrigerator 10 may be controlled and/or refrigerator 10 may provide user feedback.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the refrigerator illustrated in FIGS. 1-2 will be apparent to one of ordinary skill in the art, as will become apparent from the description below. Therefore, the invention is not limited to the specific implementations discussed herein.

Refrigerator Dispenser Control with Multi-Function Control Paddle

In the embodiments discussed hereinafter, a refrigerator utilizes a dispenser control with a multi-function control paddle to perform multiple dispenser functions in response to different types of actuation of the control paddle. The control paddle may be positioned below one or more dispenser openings and pivotable in multiple directions about one or more axes such that placement of a container below the one or more dispenser openings and against different actuation regions of the control paddle will initiate different dispenser functions.

In this regard, a dispenser control consistent with some embodiments of the invention may include a control paddle that is pivotable about one or more axes and in multiple directions about the one or more axes, and that is actuatable by a container (e.g., a glass, a cup, a bowl, a pitcher, a cooler, etc.) pressed against a surface of the control paddle. Pivoting about an axis in a particular direction generally refers to a movement of the control paddle about an axis that causes some degree of rotation in a clockwise or counter-clockwise direction about the axis. The amount of movement may vary in different embodiments, and in some embodiments may be practically imperceptible to a consumer, e.g., if a switch or sensor positioned to detect actuation of the control paddle has a relatively short throw. In other embodiments, however, a larger range of movement may be supported, and indeed, in some embodiments, a sufficient range of movement and/or range of input forces may be utilized to support a variable user input, e.g., to enable a variable dispense rate to be supported. In other embodiments, however, pivoting of the control paddle in a particular direction may result in a discrete (e.g., binary or on/off) user input.

As will become more apparent below, in some embodiments a dispenser control may include a single axis of rotation with multiple directions about that single axis of rotation defining multiple dispenser functions that may be actuated based upon the direction of pivoting about the single axis of rotation. In some embodiments, the axis may be generally vertical in orientation, whereby left and right actuation regions are defined on the control paddle, and a consumer may select different dispenser functions by pressing a container against either of the left and right actuation regions. In other embodiments, however, other axis orientations may be used, including horizontal or practically any other angle relative to a plane of the control paddle.

In other embodiments, however, a dispenser control may include multiple axes of rotation along with one or more directions about the multiple axes of rotation supporting multiple dispenser functions. In some embodiments, for example, a control paddle may be pivotable about a ball or universal joint to facilitate pivoting in multiple directions, and may support two, three or even more actuation regions on the control paddle to support multiple dispense functions with the same control paddle.

A dispenser function, in this regard, may refer to a function that dispenses a product using the dispenser. A dispenser, in this regard, may be considered to dispense multiple products, including, but not limited to, cooled water, cubed ice, crushed ice, hot water, sparkling water, coffee, another beverage (e.g., a beverage including water combined with an additive), or practically any other type of product capable of being dispensed by a refrigerator dispenser. A dispenser function may also, however, include a dispenser configuration function, e.g., to lock or unlock the dispenser (e.g., a child lock), to activate a light, to toggle or cycle between different dispenser settings, etc. In addition, in some embodiments, a dispenser function may also incorporate a combination of other dispenser functions (e.g., to concurrently dispense ice and water). Other dispenser functions may also be supported by a dispenser control in other embodiments, so the invention is not limited to the particular dispenser functions discussed herein.

In addition, as will become more apparent below, a dispenser consistent with the invention may also utilize one or more additional user controls, e.g., on a touchscreen, via additional buttons, sliders, knobs, etc., to support other dispenser functions and/or to configure various settings for the dispenser. In some embodiments, for example, an additional user control may be used to define a plurality of states that further control which dispenser function is actuated in response to actuation of a control panel. As one example, one or more additional user controls may be used to select between ice dispensing and water dispensing, such that when an ice dispensing mode is selected, a control paddle may be used to dispense cubed or crushed ice based upon a direction of actuation, while when a water dispensing mode is selected, the same control paddle may be used to dispense cooled water, or in some instances, to dispense either cooled water or a secondary beverage such as hot water, sparkling water, coffee, or another beverage. In some embodiments, for example, an additional user control for mode selection may include a slider, a hard or soft toggle button, a knob, a set of hard or soft buttons, or any other control or combinations of controls suitable for selecting from between a plurality of states.

Other variations and modifications will be discussed in greater detail below.

Figure 3:
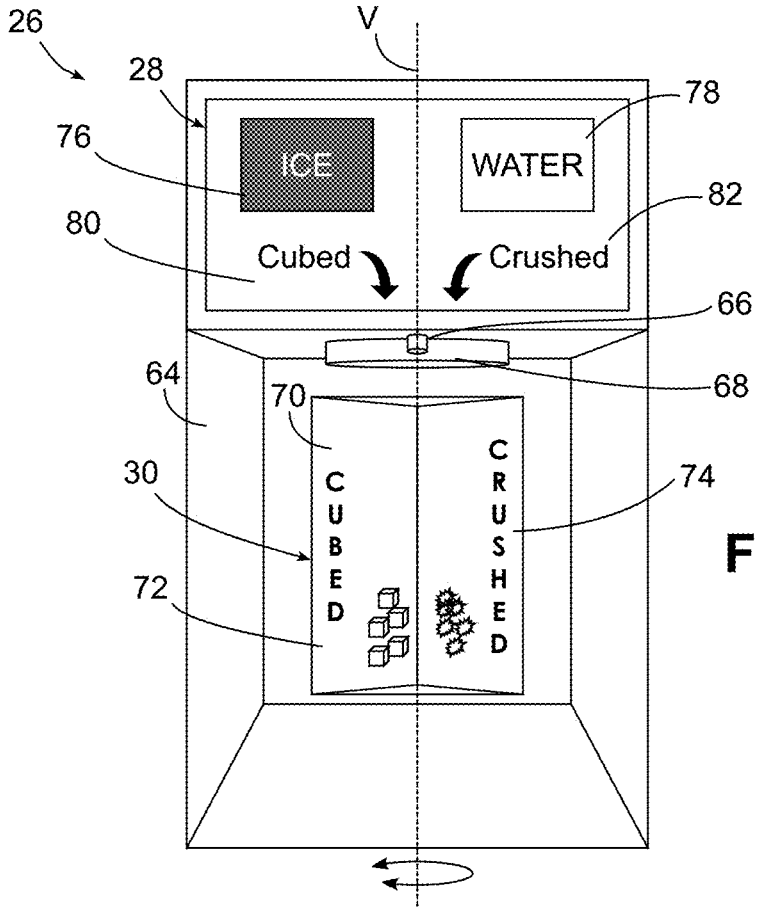
FIG. 3 is a front elevational view of the dispenser of the refrigerator of FIG. 1.

Now turning to FIG. 3, dispenser 26 of refrigerator 10 illustrates one example implementation of a multi-function dispenser control 30 consistent with the invention. Dispenser 26 includes a recess 64 within which is disposed a water or liquid dispenser opening 66 and an ice dispenser opening 68. It will be appreciated that greater or fewer dispenser openings may be supported in other embodiments, as may other opening arrangements. Further, a dispenser in some embodiments may support different dispensing locations such that different products may be dispensed from different locations on the dispenser. It will also be appreciated that various dispenser designs may be implemented to control the actual dispensing of dispenser products, including valves, pumps, icemakers, ice crushers, ice augers, etc., so incorporation of a multi-function dispenser control as described herein into a refrigerator dispenser would be well within the abilities of those of ordinary skill having the benefit of the instant disclosure.

Dispenser control 30 is disposed below dispenser openings 66, 68 and includes a control paddle 70 that is rotatable about a generally vertical axis V and that has defined thereon first and second actuation regions 72, 74. Actuation region 72 is disposed on the left side of axis V, and depression of a container against control paddle 70 within region 72 causes a first dispenser function to be actuated. Similarly, actuation region 74 is disposed on the right side of axis V, and depression of a container against control paddle 70 within region 74 causes a second dispenser function to be actuated.

In this embodiment, dispenser 26 also includes a touchscreen user control 28, which in the illustrated embodiment may display mode selection soft buttons 76, 78 to select between ice and water dispensing modes. Upon user selection of button 76, an ice dispensing mode may be selected, and button 76 may be illuminated or otherwise displayed to indicate that the ice dispensing mode is selected. Similarly, upon user selection of button 78, a water dispensing mode may be selected, and button 78 may be illuminated or otherwise displayed to indicate that the water dispensing mode is selected.

In addition, in some embodiments, based upon the particular dispensing mode selected, a pair of indicators 80, 82 may be displayed to provide a user with instructions on the dispenser functions that will be actuated in response to actuation of control paddle 70 in the first and second actuation regions 72, 74. As illustrated in FIG. 3, an ice dispensing mode is indicated by button 76, and indicators 80, 82 are configured to indicate that actuation of first actuation region 72 will cause cubed ice to be dispensed, while actuation of second actuation region 74 will cause crushed ice to be dispensed. User selection of button 78 may switch dispenser to a water dispensing mode, whereby indicators 80, 82 may be hidden (e.g., if it is desirable to dispense water regardless of whether actuation region 72 or actuation region 74 is actuated) or updated to indicate the functions supported in the water dispensing mode.

In addition, as illustrated in FIG. 3, it may be desirable to provide indicia on control paddle 70 to indicate the functions supported by the dispenser. The indicia may be printed, formed as raised or recessed features on the surface of the control paddle, or in some embodiments, may be selectively illuminated or displayed. The indicia may include alphanumeric information and/or graphics. In addition, control paddle 70 may have either a generally planar surface, or may have a non-planar surface that assists in distinguishing between different actuation regions. FIG. 3, for example, illustrates a generally triangular cross-sectional profile where a ridge extends vertically along a midline of the control paddle to further distinguish the first and second actuation regions 72, 74. Other profiles and shapes may be used in other embodiments, so the invention is not limited to the particular control paddle designs discussed herein.

Figure 4:
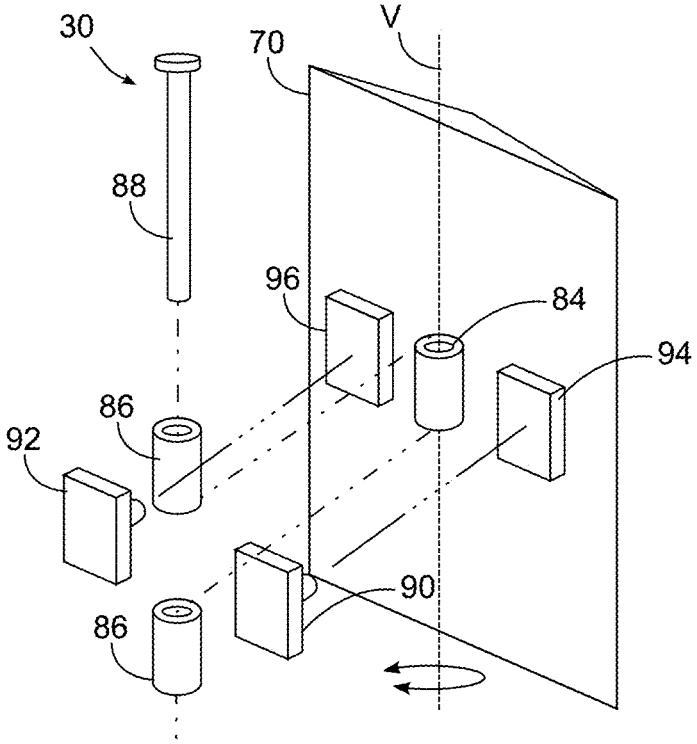
FIG. 4 is a rear exploded perspective view of the dispenser control from the dispenser of FIG. 3.

Now turning to FIG. 4, one manner of implementing dispenser control 30 is to incorporate a vertical hinge formed by a vertically-oriented sleeve 84 on a rear surface of control paddle 70, which is received between a pair of vertically-oriented sleeves 86 disposed on a fixed portion of dispenser 26, with a pin 88 extending through sleeves 84, 86 to retain control paddle 70 and enable pivotable movement about axis V. A pair of contact switches 90, 92 are disposed on opposite sides of sleeves 86 and are configured to engage raised pads 94, 96 disposed on the rear surface of control paddle 70, such that pivoting of control paddle 70 about axis V will depress the appropriate switch 90, 92. In some embodiments, switches 90, 92 may be spring-loaded to bias the control paddle to a central, inactive position, while in other embodiments a separate spring or biasing arrangement may be used to bias the control paddle to an inactive position. Switches 90, 92 may also be discrete or on/off switches in some embodiments, while in other embodiments, switches 90, 92 may output a variable signal, e.g., where a variable dispensing rate is supported by dispenser 26. Other suitable sensors include microswitches, strain sensors, pressure sensors, etc.

Figure 5:
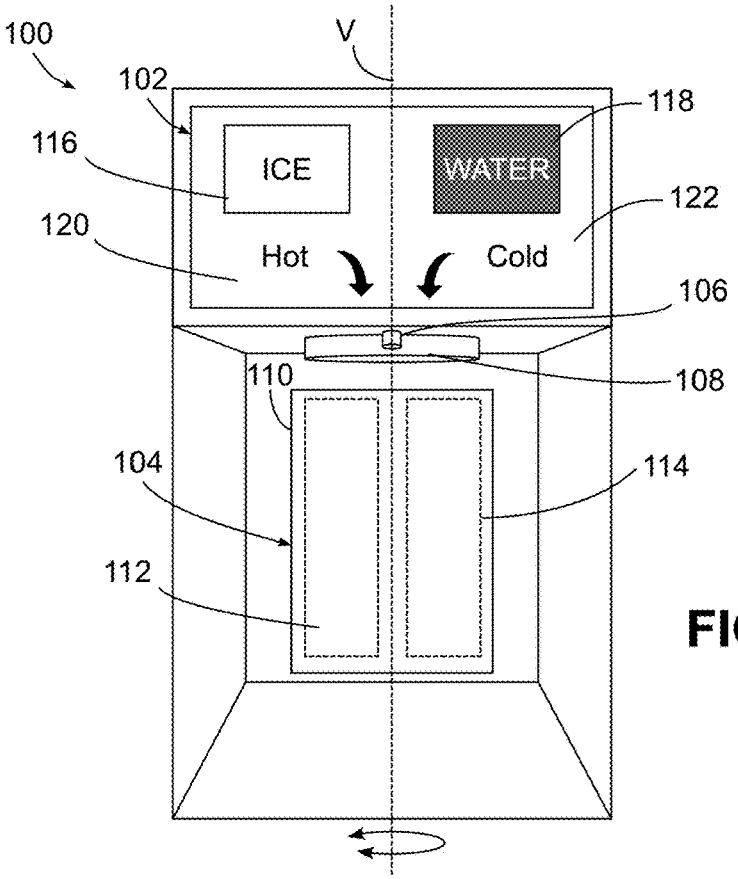
FIG. 5 is a front elevational view of another example implementation of a dispenser consistent with some embodiments of the invention.

FIG. 5 next illustrates another implementation of a dispenser 100, which includes a touchscreen 102, multi-function dispenser control 104, water or liquid dispenser opening 106, and ice dispenser opening 108. Dispenser 100 may be door-mounted in some embodiments, or may be disposed on a fixed portion of a refrigerator cabinet, or may be disposed within a compartment of a refrigerator and accessible only after opening a door.

Furthermore, in this implementation, a control paddle 110 may be pivotable about a generally vertical axis V, and may include left and right actuation regions 112, 114. Unlike dispenser 26 of FIG. 3, however, no indicial is provided on the surface of control paddle 110. Similar to dispenser 26, touchscreen 102 includes a set of soft buttons 116, 118 to select between ice and water dispensing modes, and indicators 120, 122 are provided to indicate the current dispenser functions that will be performed in response to actuation of actuation regions 112, 114 of control paddle 110 in the currently-selected dispensing mode. FIG. 5, in particular, illustrates dispenser 100 in a water dispensing mode, with soft button 118 highlighted accordingly, and with indicators 120,122 displayed to indicate that actuation of actuation region of 112 (which rotates control paddle 110 in a first direction about axis V) will initiate a hot water dispensing function for the dispenser, and that actuation of actuation region of 114 (which rotates control paddle 110 in a second direction about axis V) will initiate a cold water dispensing function for the dispenser. Similar to dispenser 26 of FIG. 3, if dispenser 100 is switched to an ice dispensing as a result of user selection of soft button 116, indicators 120, 122 may be updated to display indications similar to indicators 80, 82 of FIG. 3, such that actuation of actuation region of 112 (which rotates control paddle 110 in a first direction about axis V) while in the ice dispensing mode will initiate a cubed ice dispensing function for the dispenser, and that actuation of actuation region of 114 (which rotates control paddle 110 in a second direction about axis V) will initiate a crushed ice dispensing function for the dispenser.

Figure 6:
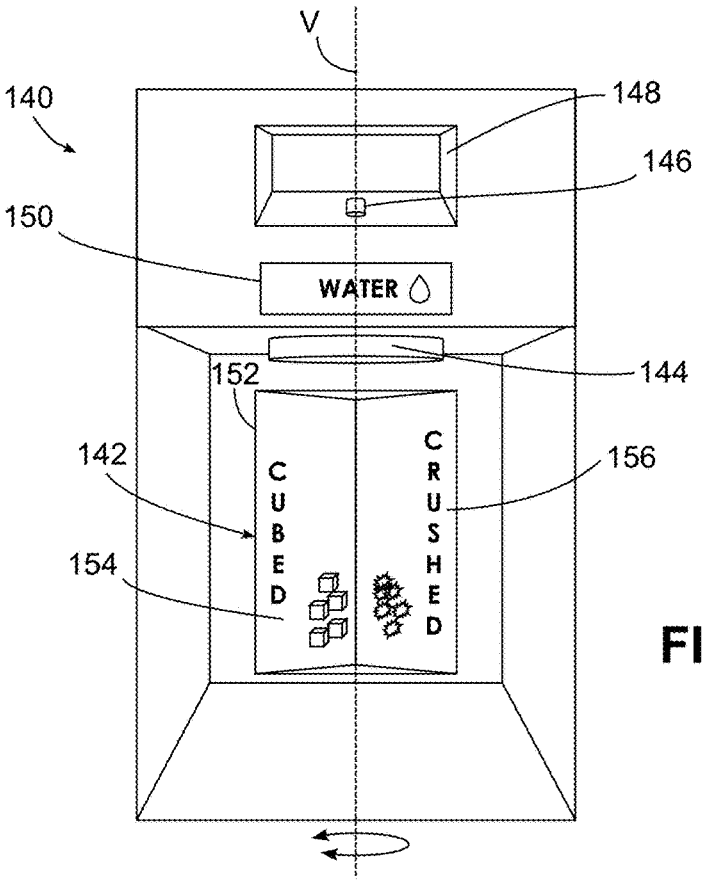
FIG. 6 is a front elevational view of yet another example implementation of a dispenser consistent with some embodiments of the invention.

FIG. 6 illustrates yet another example implementation of a dispenser 140, which includes a multi-function dispenser control 142 disposed below an ice dispenser opening 144. Unlike the other implementations discussed above, however, dispenser 140 separates the water dispensing function from the ice dispensing function, and rather than having a water dispenser opening co-located with ice dispenser opening 144, a separate water dispenser opening 146 is provided at a higher elevation from ice dispenser opening 144, and is disposed on a forward projection 148 that extends outwardly from the dispenser. In addition, rather than utilizing a common dispenser control to dispense ice and water, a separate water dispenser control 150 is disposed below water dispenser opening 146 such that dispensing of water into a container requires depression of control 150 rather than control 142. Dispenser control 142 is otherwise similar to dispenser control 30 of FIG. 3 and includes a control paddle 152 defining first and second actuation regions 154, 156.

As such, dispenser 140 supports dispensing cold or cooled water, cubed ice, and crushed ice without the need for selection of particular water or ice dispensing mode. If water dispensing is desired, a user places a container under water dispenser opening 146 and against water dispenser control 150 to initiate a water dispensing function and actuate water dispensing by dispenser 140. If dispensing of cubed ice is desired, a user places a container under ice dispenser opening 144 and against actuation region 154 of control paddle 152 to initiate a cubed ice dispensing function and actuate ice dispensing by dispenser 140 with an ice crusher deactivated. Likewise, if dispensing of crushed ice is desired, a user places a container under ice dispenser opening 144 and against actuation region 156 of control paddle 152 to initiate a crushed ice dispensing function and actuate ice dispensing by dispenser 140 with an ice crusher activated.

Now turning to FIG. 7, as noted above in some embodiments it may be desirable to utilize multiple pivoting axes, as is the case for dispenser 200, which includes a multi-function dispenser control 202 disposed within a recess 204 and including a multi-axis control paddle 206 disposed below a water or liquid dispenser opening 208 and ice dispenser opening 210. Control paddle 206 is pivotable about both a generally vertical axis V and a generally horizontal axis H, which may support greater than two (i.e., three or more) actuation regions. For example, in some embodiments, it may be desirable to define cubed and crushed ice actuation regions 212, 214 to either side of vertical axis V to support respective cubed and crushed ice dispense functions. Likewise, a cooled water actuation region 216 may be defined at a top end of control paddle 206 to support a water dispense function.

Further, as noted above, a multi-function dispenser control in some embodiments may support additional dispenser functions beyond dispensing. In the illustrated embodiment, for example, it may be desirable to define a lock/unlock actuation region 218 at a bottom end of control paddle 206 to support locking and unlocking dispenser functions that together implement a child lock, such that when the dispenser is in a locked mode dispensing is disabled. Actuation of the lock/unlock actuation region 218, for example, may toggle between locked and unlocked modes. In some instances it may also be desirable to require actuation of the control paddle 206 within the lock/unlock actuation region 218 for a predetermined amount of time in order to trigger the associated function and thereby minimize inadvertent toggling between modes. For example, a consumer may be required in some embodiments to depress the control paddle within the lock/unlock actuation region for at least 2 seconds to toggle between modes. It will be appreciated that other dispenser functions may also be associated with a predetermined time, and that other dispenser settings may be configured in a similar manner using an actuation region on a control paddle.

It will also be appreciated that some actuation regions may actuate multiple dispenser functions. For example, in some embodiments it may also be desirable to support additional actuation regions 220, 222 between actuation regions 212 and 216 and 214 and 216, respectively, to implement combined dispense functions. Actuation region 220, for example, may be used to perform a combined cubed ice and water dispense function that concurrently dispenses cubed ice and water, while actuation region 222 may be used to perform a combined crushed ice and water dispense function that concurrently dispenses crushed ice and water.

Figure 7:
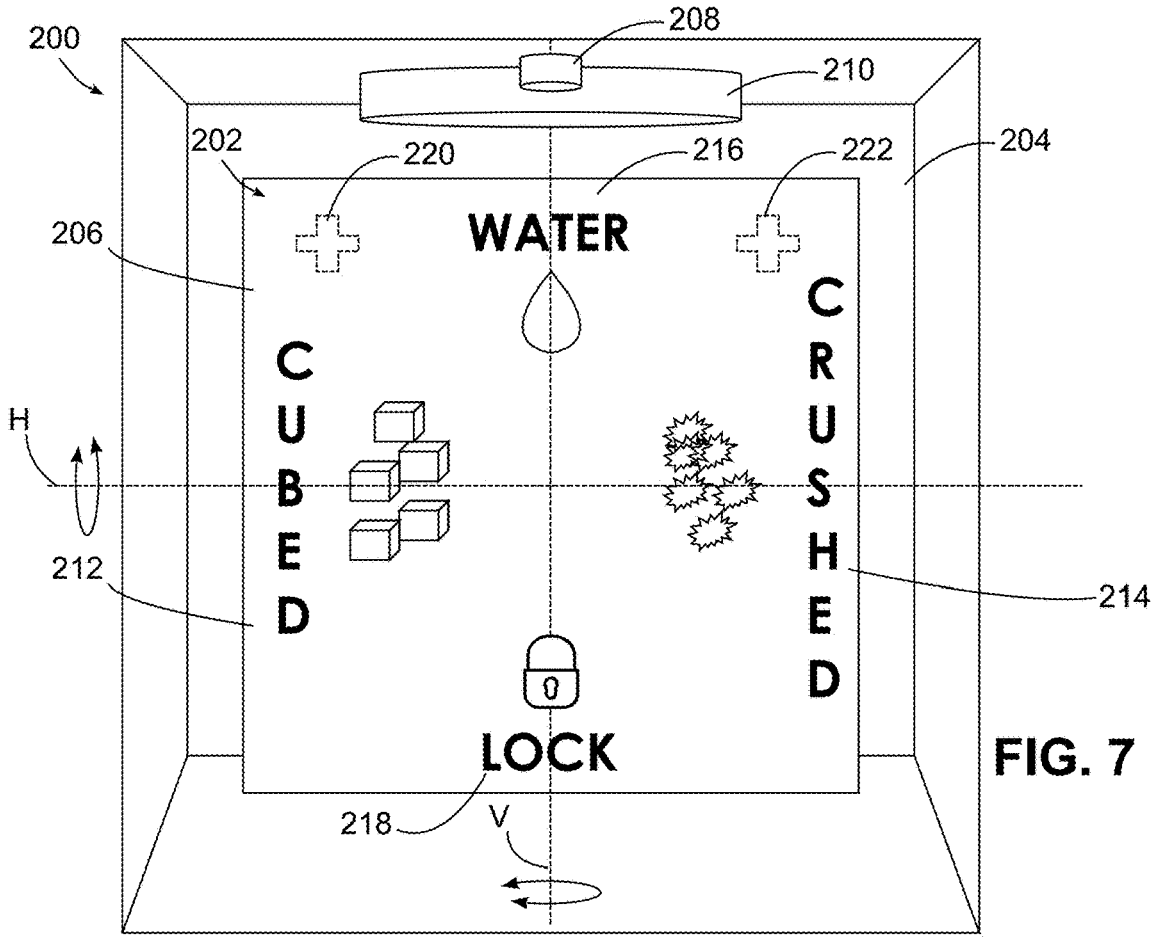
FIG. 7 is a front elevational view of still another example implementation of a dispenser consistent with some embodiments of the invention.

As is also illustrated in FIG. 7, based upon a comparison of control paddle 206 with other control paddles illustrated herein (e.g., control paddle 70 of FIG. 3), it will be appreciated that a control paddle consistent with the invention may have other shapes (control paddle 206 is generally square in shape), as well as other cross-sectional profiles (the outward facing surface of control paddle 206 is generally planar, and lacks the triangular profile of control paddle 70). Further, other combinations of alphanumeric and/or graphical indicia may be utilized on a control paddle as is appropriate for the functions supported by the control paddle.

Figure 8:
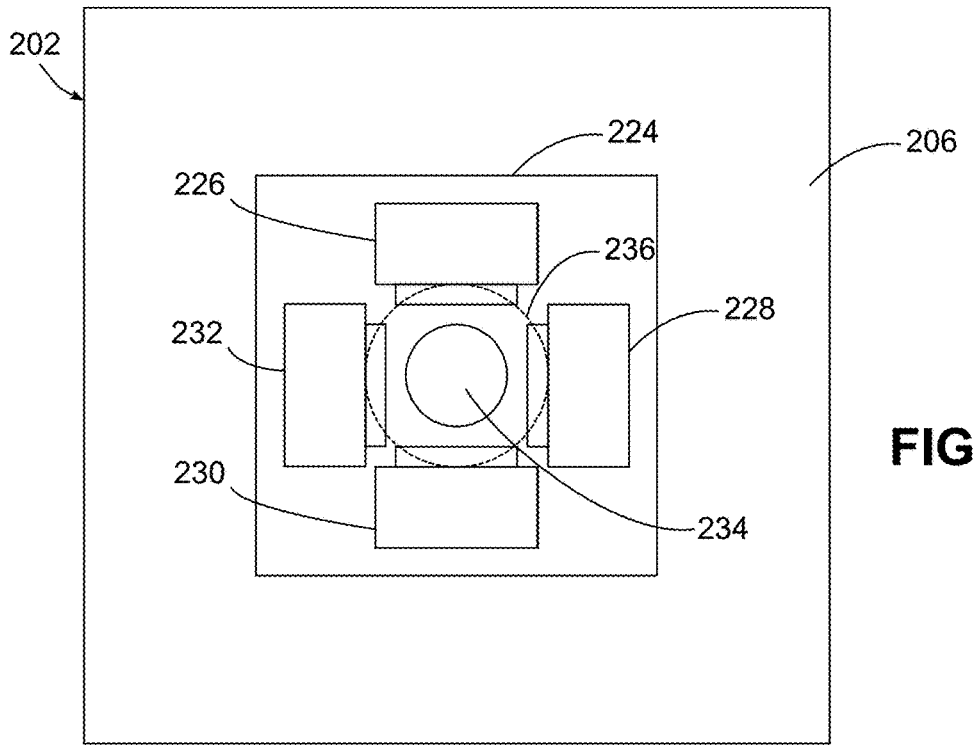
FIG. 8 is a rear elevational view of the dispenser control for the dispenser of FIG. 7.

Further, as illustrated in FIG. 8, other sensors and mounting arrangements may be used in a multi-function dispenser control consistent with the invention. In particular, for dispenser control 202 (the back side of which is illustrated in FIG. 8), a 4-way or 8-way multi-axis sensor 224, similar to a joystick, may be used to support control paddle 206 for pivoting about multiple axes. Sensor 224 may include four switches 226, 228, 230 and 232 positioned at 0, 90, 180 and 270 degrees around a shaft 234 extending from a ball mount 236. Ball mount 236 is fixedly mounted to the rear surface of control paddle 206 at an opposite end from shaft 234 and supports pivoting of control paddle 206 in any arbitrary direction (although desirably rotation of control paddle 206 about the axis of shaft 234 is restricted). Further, pivoting of control paddle 206 in one direction rotates ball mount 236 and causes shaft 234 to move in essentially the opposite direction to engage one or more of switches 228, 230, 232, 234. As such, and with additional reference to FIG. 7, depression of cubed ice actuation region 212 will be signaled by engagement of shaft 234 with switch 232, depression of crushed ice actuation region 214 will be signaled by engagement of shaft 234 with switch 228, depression of water actuation region 216 will be signaled by engagement of shaft 234 with switch 230, and depression of lock/unlock actuation region 218 will be signaled by engagement of shaft 234 with switch 226. Further, with respect to actuation region 220, activation of this combined dispense function will be signaled by engagement of shaft 234 with both switches 230 and 232, while for actuation region 222, activation of this combined dispense function will be signaled by engagement of shaft 234 with both switches 228 and 230.

In this design, the positions represented by the combination of switches 226 and 228 and the combination of switches 226 and 232 may not be associated with a function, or in the alternative, may be assigned to a neighboring actuation region, e.g., to effectively expand the size of any of actuation region 212, 214 or 218.

Figure 11:
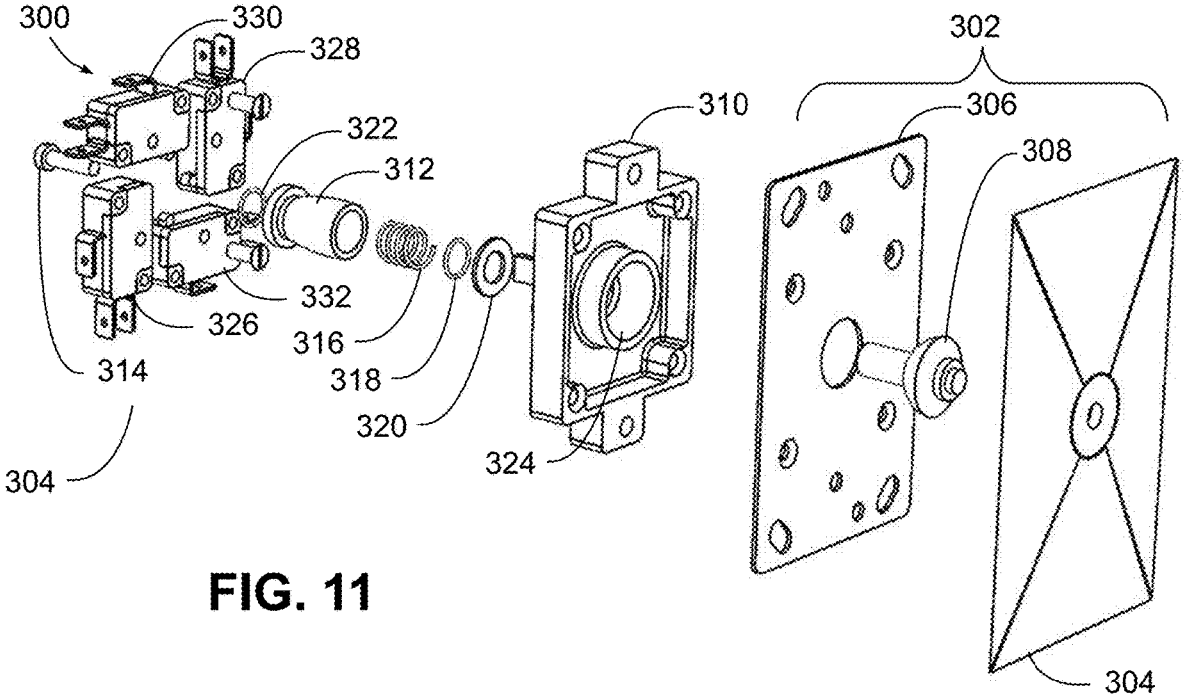
FIG. 11 is an exploded perspective view of another example implementation of a dispenser control consistent with some embodiments of the invention.
Figure 12:
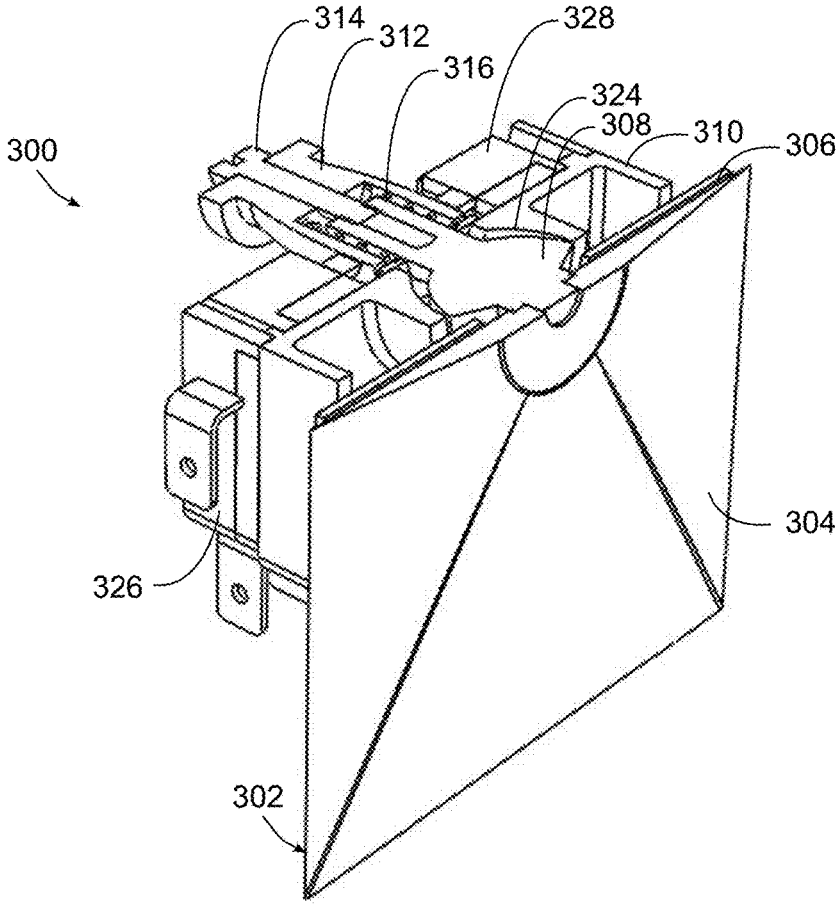
FIG. 12 is a perspective view of the dispenser control of FIG. 11, with portions thereof cut away.

Now turning to FIGS. 11 and 12, these figures illustrate yet another example implementation of a dispenser control 300, which includes a control paddle 302 including an outer surface 304 mated with a mounting plate 306, and mounted to a pivot member 308 that extends through a control mount 310. Pivot member 308 mates with a plunger member 312 and includes a rearwardly-facing threaded aperture that receives a threaded fastener 314. A spring 316 and washers 318, 320 and 322 are received on a shaft of pivot member 308, and pivot member 308 further includes a generally hemispherical pivot surface that is received within a generally hemispherical cup 324 formed in control mount 310. In addition, four microswitches 326, 328, 330 and 332 are arranged around plunger 312 such that pivoting of control paddle 302 engages one or more of microswitches 326-332, similar to the operation of dispenser control 202 discussed above in connection with FIGS. 7-8.

Specifically, dispenser control 300 may be mounted on the back surface of a dispenser such that the control paddle is accessible at a comfortable height. The control paddle is pivoted about a point, here a spherical surface, to provide up to 8 different functions corresponding to the individual microswitches 326-332 and pairs of microswitches 326-332 that are activated collectively in response to depression of the control paddle at one of its four corners (i.e., diagonally). In some embodiments, dampers may also be provided behind the control paddle for smoother operation, and moreover, crevices may be sealed in some embodiments to minimize exposure of electrical components to moisture or water. The assembly of pivot member 308, plunger member 312, threaded fastener 314, and spring 316 control the overall sensitivity of the control, with spring 316 providing the stiffness and plunger member 312 providing appropriate clearance between its actuating surface and each microswitch. In addition, in some embodiments, the entire assembly may be enclosed behind a membrane for seamless appearance and moisture/water protection.

Figure 9:
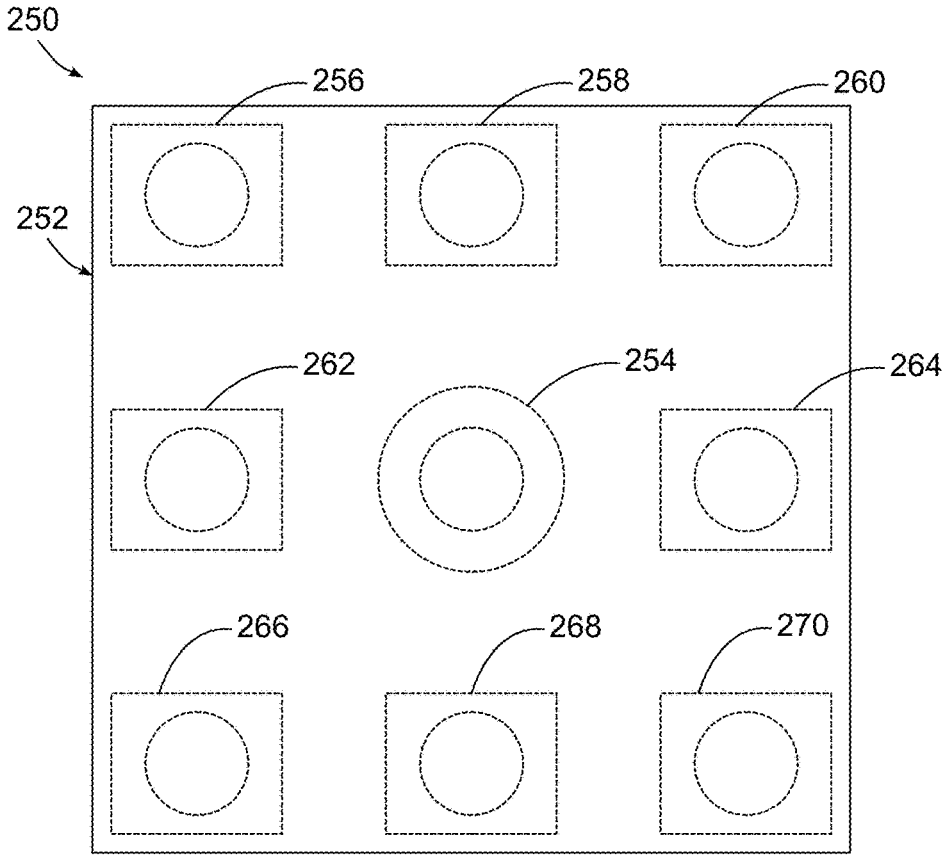
FIG. 9 is a front elevational view of another example implementation of a dispenser control consistent with some embodiments of the invention.
Figure 10:
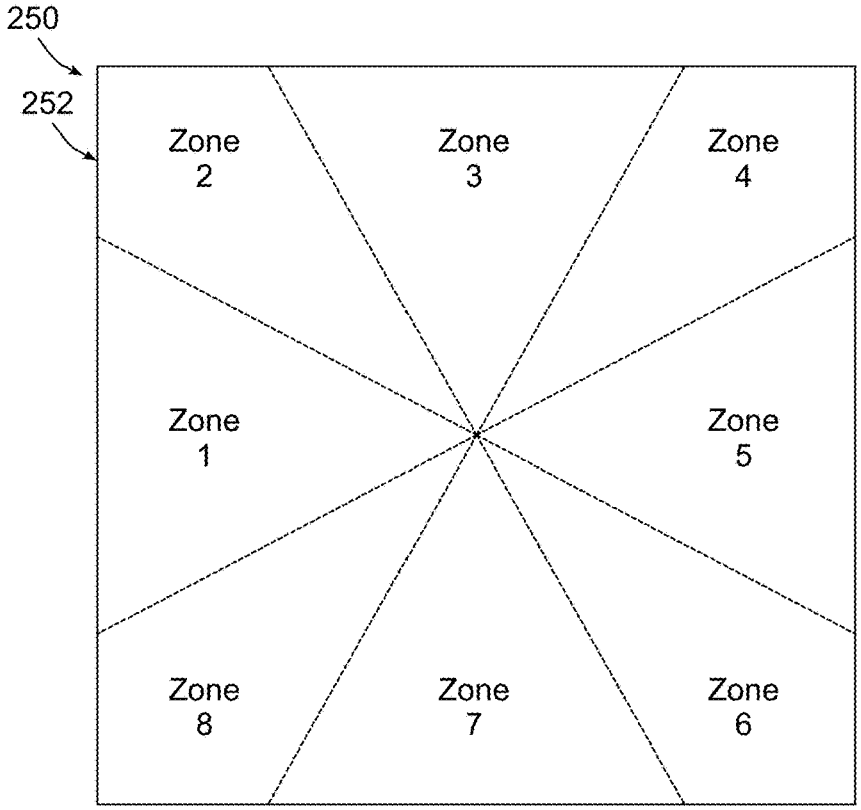
FIG. 10 is a front elevational view of the actuation zones of the dispenser control of FIG. 9.

Other sensors and/or mechanical couplings may be used to implement a multi-function dispenser control in other embodiments, including both variable sensors (i.e., sensors that can distinguish how far in one direction a control paddle has been actuated) and discrete sensors (i.e., sensors that can only signal whether a control paddle has been actuated in a particular direction or not). FIG. 9, for example, illustrates a multi-function dispenser control 250 including a control paddle 252 that is mounted to a ball or universal joint mount 254 (or other suitable mechanical coupling supporting multi-axis pivoting) and positioned adjacent an array of switches 256-270 (mount 254 and switches 256-270 are illustrated in dashed lines behind the surface of control paddle 252). With reference to FIG. 10, it may be seen that the array of switches may define up to eight separate zones or actuation regions to which unique functions may be assigned. These functions may include any of the various types of functions discussed above, e.g., a cooled water dispense function, a cubed ice dispense function, a crushed ice dispense function, a hot water dispense function, a sparkling water dispense function, a beverage dispense function, a coffee dispense function, a dispenser lock function, a dispenser unlock function, a multiple or combined dispense product dispense function, etc. In some instances, these different actuation regions may be associated with different combinations of switches 256-270 due to the planar nature of control paddle 252, e.g., whereby zone 1 is signaled by activation of switch 262 in combination with one or both of switches 256, 266, zone 2 is signaled by switch 256 in combination with one or both of switches 258, 262, etc. In addition, switches 256-270 may be binary or on/off switches in some embodiments, while in other embodiments the switches may output variable signals based upon the degree of activation.

It will be appreciated that various additional modifications may be made to the embodiments discussed herein, and that a number of the concepts disclosed herein may be used in combination with one another or may be used separately. Therefore, the invention lies in the claims hereinafter appended.

What is claimed is:

1. A refrigerator, comprising:

a cabinet including one or more food compartments and one or more doors closing the one or more food compartments; and a dispenser mounted to the cabinet to dispense a plurality of dispense products, the dispenser including:

one or more dispenser openings configured to dispense the plurality of dispense products; and a dispenser control positioned below the one or more dispenser openings and actuatable by a container placed below the one or more dispenser openings, the dispenser control including a control paddle being pivotable in first and second directions about a generally vertical axis, wherein pivoting of the control paddle about the generally vertical axis in the first direction actuates the dispenser to dispense a first dispense product among the plurality of dispense products, and pivoting of the control paddle about the generally vertical axis in the second direction actuates the dispenser to dispense a second dispense product among the plurality of dispense products, wherein the dispenser control includes a generally vertical hinge and first and second switches disposed on opposite sides of the generally vertical hinge, the first switch engaged in response to pivoting of the control paddle about the generally vertical axis in the first direction, and the second switch engaged in response to pivoting of the control paddle about the generally vertical axis in the second direction.

2. The refrigerator of claim 1, wherein the control paddle is further pivotable about a generally horizontal axis, and pivoting of the control paddle about the generally horizontal axis actuates the dispenser to dispense a third dispense product among the plurality of dispense products.

3. The refrigerator of claim 2, wherein the control paddle is pivotable in third and fourth directions about the generally horizontal axis, wherein pivoting of the control paddle about the generally horizontal axis in the third direction actuates the dispenser to dispense the third dispense product, and pivoting of the control paddle about the generally horizontal axis in the fourth direction actuates a predetermined dispenser function.

4. The refrigerator of claim 3, wherein the predetermined dispenser function is a dispenser lock or dispenser unlock function.

5. The refrigerator of claim 2, wherein pivoting of the control paddle about the generally horizontal axis in combination with pivoting of the control paddle about the generally vertical axis in the first direction actuates the dispenser to concurrently dispense both the first and third dispense products.

6. The refrigerator of claim 5, wherein pivoting of the control paddle about the generally horizontal axis in combination with pivoting of the control paddle about the generally vertical axis in the second direction actuates the dispenser to concurrently dispense both the second and third dispense products.

7. The refrigerator of claim 1, wherein the dispenser further comprises an additional user control having a plurality of states, wherein pivoting of the control paddle about the generally vertical axis in the first direction actuates the dispenser to dispense the first dispense product further based upon a selected state of the additional user control.

8. The refrigerator of claim 7, wherein the plurality of states of the additional user control includes an ice dispensing state and a water dispensing state, and wherein:

pivoting of the control paddle about the generally vertical axis in the first direction when the additional user control is in the ice dispensing state actuates the dispenser to dispense cubed ice;

pivoting of the control paddle about the generally vertical axis in the second direction when the additional user control is in the ice dispensing state actuates the dispenser to dispense crushed ice; and pivoting of the control paddle about the generally vertical axis in the first direction when the additional user control is in the water dispensing state actuates the dispenser to dispense water.

9. The refrigerator of claim 8, wherein pivoting of the control paddle about the generally vertical axis in the second direction when the additional user control is in the water dispensing state actuates the dispenser to dispense water.

10. The refrigerator of claim 8, wherein pivoting of the control paddle about the generally vertical axis in one of the first and second directions when the additional user control is in the water dispensing state actuates the dispenser to dispense cooled water, and wherein pivoting of the control paddle about the generally vertical axis in the other of the first and second directions when the additional user control is in the water dispensing state actuates the dispenser to dispense a secondary beverage.

11. The refrigerator of claim 10, wherein the secondary beverage is hot water or sparkling water.

12. The refrigerator of claim 1, wherein the dispenser control includes a multi-axis sensor configured to sense pivoting of the control paddle about multiple axes.

13. The refrigerator of claim 1, wherein the dispenser control is a variable dispenser control, and wherein the dispenser is configured to vary a dispense rate in response to the dispenser control.

14. The refrigerator of claim 1, wherein each of the first and second dispense products is cooled water, cubed ice, crushed ice, hot water, sparkling water, a beverage or coffee.

15. A refrigerator, comprising:

a cabinet including one or more food compartments and one or more doors closing the one or more food compartments; and a dispenser mounted to the cabinet to dispense a plurality of dispense products, the dispenser including:

one or more dispenser openings configured to dispense the plurality of dispense products; and a dispenser control positioned below the one or more dispenser openings and actuatable by a container placed below the one or more dispenser openings, the dispenser control including a control paddle coupled to a ball mount and being pivotable in a plurality of directions and about multiple axes to actuate the dispenser to perform three or more dispenser functions.

16. The refrigerator of claim 15, wherein each of the three or more dispenser functions is a cooled water dispense function, a cubed ice dispense function, a crushed ice dispense function, a hot water dispense function, a sparkling water dispense function, a beverage dispense function, a coffee dispense function, a dispenser lock function, a dispenser unlock function, or a multiple dispense product dispense function.

17. A refrigerator dispenser, comprising:

one or more dispenser openings configured to dispense a plurality of dispense products; and a dispenser control positioned below the one or more dispenser openings and actuatable by a container placed below the one or more dispenser openings, the dispenser control including a control paddle being pivotable in a plurality of directions and about one or more axes to actuate the dispenser to perform two or more dispenser functions, wherein the dispenser control includes a generally vertical hinge and first and second switches disposed on opposite sides of the generally vertical hinge, the first switch engaged in response to pivoting of the control paddle about the generally vertical axis in the first direction, and the second switch engaged in response to pivoting of the control paddle about the generally vertical axis in the second direction.

18. The refrigerator dispenser of claim 17, wherein each of the two or more dispenser functions is a cooled water dispense function, a cubed ice dispense function, a crushed ice dispense function, a hot water dispense function, a sparkling water dispense function, a beverage dispense function, a coffee dispense function, a dispenser lock function, a dispenser unlock function, or a multiple dispense product dispense function.

19. The refrigerator dispenser of claim 17, wherein pivoting of the control paddle about the generally vertical axis in the first direction actuates the dispenser to dispense a first dispense product among the plurality of dispense products, and pivoting of the control paddle about the generally vertical axis in the second direction actuates the dispenser to dispense a second dispense product among the plurality of dispense products.

20. The refrigerator dispenser of claim 19, wherein the one or more axes further includes a generally horizontal axis, and pivoting of the control paddle about the generally horizontal axis actuates the dispenser to dispense a third dispense product among the plurality of dispense products.

21. A method of operating a refrigerator dispenser of a type including one or more dispenser openings configured to dispense a plurality of dispense products, the method comprising:

performing a first dispenser function among a plurality of dispenser functions in response to sensing actuation of a control paddle of the dispenser control positioned below the one or more dispenser openings in a first direction about one or more axes about which the control paddle is pivotable; and performing a second dispenser function among the plurality of dispenser functions in response to sensing actuation of the control paddle in a second direction about the one or more axes;

wherein the one or more axes includes a generally vertical axis and the first and second directions are about the generally vertical axis, wherein the dispenser control includes a generally vertical hinge and first and second switches disposed on opposite sides of the generally vertical hinge, the first switch engaged in response to pivoting of the control paddle about the generally vertical axis in the first direction, and the second switch engaged in response to pivoting of the control paddle about the generally vertical axis in the second direction.

22. The method of claim 21, wherein each of the plurality of dispenser functions is a cooled water dispense function, a cubed ice dispense function, a crushed ice dispense function, a hot water dispense function, a sparkling water dispense function, a beverage dispense function, a coffee dispense function, a dispenser lock function, a dispenser unlock function, or a multiple dispense product dispense function.

23. The method of claim 21, wherein the first dispenser function actuates the dispenser to dispense a first dispense product among the plurality of dispense products, and the second dispenser function actuates the dispenser to dispense a second dispense product among the plurality of dispense products.

24. The method of claim 23, wherein the one or more axes further includes a generally horizontal axis, the method further comprising performing a third dispenser function among the plurality of dispenser functions in response to sensing actuation of the control paddle in a third direction about the generally horizontal axis.

* * * * *